US009469139B2

(12) United States Patent
Sakano et al.

(10) Patent No.: US 9,469,139 B2
(45) Date of Patent: Oct. 18, 2016

(54) TAPE CARTRIDGE

(71) Applicant: Seiko Epson Corporation, Tokyo (JP)

(72) Inventors: Hideki Sakano, Suwa (JP); Hideo Sodeyama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/741,270

(22) Filed: Jun. 16, 2015

(65) Prior Publication Data

US 2015/0283835 A1 Oct. 8, 2015

Related U.S. Application Data

(63) Continuation of application No. PCT/JP2015/058311, filed on Mar. 19, 2015.

(30) Foreign Application Priority Data

Mar. 24, 2014 (JP) ..... 2014-060909

(51) Int. Cl.
*B41J 32/00* (2006.01)
*B41J 3/407* (2006.01)
*B41J 15/04* (2006.01)

(52) U.S. Cl.
CPC ..... *B41J 32/00* (2013.01); *B41J 3/4075* (2013.01); *B41J 15/044* (2013.01)

(58) Field of Classification Search
CPC ..... B41J 2/305
See application file for complete search history.

(56) References Cited

U.S. PATENT DOCUMENTS 6,485,206 B1 * 11/2002 Takahashi ..... 400/207
2010/0247208 A1 * 9/2010 Yamaguchi et al. ..... 400/207
2012/0080550 A1 * 4/2012 Yamaguchi et al. ..... 242/160.4

FOREIGN PATENT DOCUMENTS

JP 2011-046142 A 3/2011
JP 2012-152951 A 8/2012
JP 2013-111756 A 6/2013

OTHER PUBLICATIONS

International Search Report, Jun. 9, 2015, issued in related Patent Application No. PCT/JP2015/058311.

* cited by examiner

*Primary Examiner* — An Do
*Assistant Examiner* — Renee I Wilson
(74) *Attorney, Agent, or Firm* — ALG Intellectual Property, LLC

(57) ABSTRACT

A tape cartridge to be installed in a tape printing apparatus by which a printing tape is fed out to perform printing on the printing tape, includes the printing tape, a cartridge casing in which the printing tape is accommodated, and a reaction force application portion that is provided on a front surface of the cartridge casing, displaced by a pressing force of a pressing portion of the tape printing apparatus, and applies a reaction force against the pressing force to the pressing portion according to a displacement of the reaction force application portion.

15 Claims, 10 Drawing Sheets

TAPE CARTRIDGE

CROSS REFERENCE TO RELATED APPLICATION

This application is a continuation of PCT application No. PCT/JP2015/058311, which was filed on Mar. 19, 2015 based on Japanese Patent Application No. 2014-060909 filed on Mar. 24, 2014, the contents of which are incorporated herein by reference.

BACKGROUND

1. Technical Field

The present invention relates to a tape cartridge installed on the cartridge installation portion of a tape printing apparatus to be used and subjected to printing by the tape printing apparatus.

2. Background Art

Up until now, a tape cassette installed on the cassette installation portion of a printing apparatus in its positioned state has been known as such a tape cartridge. See JP-A-2012-152951.

The tape cassette includes an adhesive tape spool on which a double-sided adhesive tape is wound, a film tape spool on which a film tape (printing tape) is wound, and a ribbon spool on which an ink ribbon is wound. In addition, the tape cassette includes a ribbon winding-up spool that winds up the ink ribbon, a tape driving roller, and a cassette casing that accommodates these constituents. Moreover, pin holes are provided at two places of both end margins in the longitudinal direction of the cassette casing.

On the other hand, the printing apparatus includes a main body cover in which the cassette installation portion is recessed and a cover that opens/closes the cassette installation portion. The cassette installation portion is provided with a head holder on which a tape driving shaft, a ribbon winding-up shaft, and a printing head are mounted, and is further provided with two positioning pins with which the pin holes described above engage. In addition, a cassette pressing mechanism that presses the tape cassette installed on the cassette installation portion is provided inside the cover.

The cassette pressing mechanism includes a pressing plate rotatably attached to the cover, two coil-shaped elastic bodies interposed between the pressing plate and the cover, and three pressing members that project from the pressing plate and press the tape cassette.

The tape cassette is installed on the cassette installation portion so as to make the pin holes engage with the positioning pins of the cassette installation portion. When the cover is closed in this state, the three pressing members of the cassette pressing mechanism press the tape cassette with the elastic forces of the elastic bodies. Thus, the tape cassette is positioned at the cassette installation portion and subjected to printing by a printing head.

Meanwhile, in consideration of errors in manufacturing the tape cassette (a cassette casing), the positioning pins of the cassette installation portion and the pin holes of the tape cassette are in engagement with each other so as to make allowance for dimensional tolerances. Therefore, if a pressing force to the tape cassette in the installation direction becomes weak, a positional deviation or floating is likely to occur in the tape cassette.

In the known printing apparatus described above, the tape cassette is pressed (positioned) by the coil-shaped elastic bodies (coil springs) provided on the cover. However, the elastic bodies have a problem in that the pressing forces (spring forces) are weakened with time. That is, reduction in the pressing forces is caused due to the occurrence of so-called "loss of springiness." In particular, a plurality of types of tape cassettes having a different thickness is available as the tape cassette, and the shrinkage of the elastic bodies is different among the tape cassettes. Therefore, there is a case that the pressing forces become insufficient due to the "loss of springiness" of the elastic bodies depending on the thicknesses of the tape cassettes. In addition, the three pressing members of the cassette pressing mechanism largely project inside the cover. Therefore, a hindrance to the attachment/detachment of the tape cassette is caused by pressing members.

The present invention has an object of providing a tape cartridge that allows pressing for positioning to be appropriately and stably performed regardless of the structure of an apparatus or the size of the thickness of a cartridge casing.

SUMMARY OF THE INVENTION

According to the present invention, there is provided A tape cartridge to be installed in a tape printing apparatus by which a printing tape is fed out to perform printing on the printing tape, includes the printing tape, a cartridge casing in which the printing tape is accommodated, and a reaction force application portion that is provided on a front surface of the cartridge casing, displaced by a pressing force of a pressing portion of the tape printing apparatus, and applies a reaction force against the pressing force to the pressing portion according to a displacement of the reaction force application portion.

In this case, the reaction force is preferably increased in proportion to a displacing amount of the reaction force application portion.

According to these configurations, the reaction force application portion provided on the cartridge casing is displaced by the pressing force of the pressing portion of the tape printing apparatus and applies the reaction force to the pressing portion according to the displacing amount. That is, the cartridge casing is elastically pressed by the pressing portion via the reaction force application portion. Thus, the cartridge casing is positioned at a prescribed position on the side of the tape printing apparatus. The tape cartridge itself is a consumable item and replaced when the printing tape is consumed. Accordingly, since the tape cartridge is replaced before the prescribed reaction force of the reaction force application portion becomes ineffective, the occurrence of the "loss of springiness" caused in the related art can be reduced. In addition, since the reaction force application portion is provided on the cartridge casing, a hindrance to the tape cartridge itself can be reduced. Accordingly, pressing for positioning can be appropriately and stably performed regardless of the structure of the apparatus or the size of the thickness of the cartridge casing.

In addition, the cartridge casing preferably has a shell structure.

According to this configuration, the reaction force application portion can be easily formed using vacant space inside the cartridge casing.

Moreover, the reaction force application portion preferably includes an elastic portion elastically deformed by the pressing force.

According to this configuration, the reaction force application portion can be simply structured. Therefore, the productivity of the tape cartridge can be increased, and an increase in the production cost can be reduced.

In this case, the elastic portion preferably includes an elastic piece having a part with which the pressing portion comes in contact, the part being provided at an area formed by linearly cutting off a casing wall of the cartridge casing.

In this case, the elastic piece is preferably formed by cutting off the casing wall into a "U"-shape.

According to this configuration, the elastic portion can be extremely easily provided on the cartridge casing by molding, processing, or the like. That is, the elastic portion can be simply structured.

In addition, the elastic portion preferably includes an elastic piece that is formed in an L-shaped cross section on a plane section crossing the front surface of the cartridge casing, extends from a casing wall of the cartridge casing to an inside of the cartridge casing which is at an opposite side to the front surface, and with which the pressing portion coming in contact, and a reception opening that is formed on the casing wall and receives the pressing portion.

According to this configuration, since the elastic piece is formed in the "L"-shape in cross section, it can achieve a larger stroke in its elastic deformation than a planar elastic piece and secure a reaction force (received pressing force). In addition, the reception opening can function as a contact guide for the pressing portion.

In this case, the reception opening preferably includes two sides corresponding to both side ends of the elastic piece, and tape cartridge is preferably positioned by the pressing portion in a direction crossing the two sides.

According to this configuration, the pressing portion itself can function as a positioning member for the cartridge casing. Thus, the tape cartridge is pressed to the tape printing apparatus in its positioned state. Accordingly, the installed tape cartridge can be accurately positioned in the tape printing apparatus.

In addition, the elastic piece is preferably formed on the front surface of the cartridge casing at a corner portion of the front surface.

According to this configuration, the elastic piece can be disposed at a high-rigidity part of the cartridge casing. Thus, the pressing force of the pressing portion that presses the tape cartridge to the tape printing apparatus can be prevented from being absorbed by the deformation of the cartridge casing. Accordingly, the pressing force applied to the tape cartridge can be secured.

Moreover, the tape printing apparatus preferably includes a cartridge installation portion on which the tape cartridge is installed and an opening/closing cover that opens/closes the cartridge installation portion about a hinge portion, the pressing portion is preferably provided on the opening/closing cover, and the elastic piece preferably extends in a direction crossing an extending direction of the hinge portion, a side of the hinge portion of which is a base end.

According to this configuration, the elastic piece can be deformed in the same direction as the rotation direction of the opening/closing cover. Thus, the contact area between the pressing portion and the elastic piece is not moved (slid) when the elastic piece is deflected, and thus the pressing force applied to the tape cartridge can be secured.

On the other hand, the reaction force application portion preferably includes a receiving recessed portion that is formed on a casing wall of the cartridge casing and receives the pressing portion, and an elastic member that is provided on the receiving recessed portion and constituted separately from the cartridge casing.

According to this configuration, the elastic member can achieve a large stroke in its elastic deformation, and the reaction force (the applied pressing force) can be secured. In addition, the receiving recessed portion can function as a contact guide for the pressing portion.

In this case, the elastic member is preferably made of at least one of a resin elastic material and a metal elastic material.

According to this configuration, the elastic member can be selected in consideration of the properties or the cost of the cartridge casing.

In this case, the resin elastic material is preferably made of at least one of rubber and a sponge.

Similarly, the metal elastic material is preferably made of at least one of a leaf spring and a coil spring.

According to these configurations, the elastic member can be simply structured, and an increase in the cost can be reduced.

In addition, the reaction force application portion preferably faces the pressing portion and is preferably provided on one surface of the cartridge casing crossing an installation direction, and a detected portion that detects attribute information of the printing tape is preferably provided on the other surface of the cartridge casing.

According to this configuration, the detected portion can appropriately function with respect to the tape printing apparatus.

On the other hand, the tape printing apparatus preferably includes an installation base surface that positions the tape cartridge in the installation direction, a plurality of types of cartridge casings having a different thickness in the installation direction is preferably available as the cartridge casing to be installed in the tape printing apparatus, and the reaction application portion in each of the cartridge casings is preferably disposed such that a distance between the installation base surface and a part of the reaction application portion with which the pressing portion comes in contact becomes substantially equal among the plurality of types of the cartridge casings.

According to this configuration, since each of the cartridge casings (the tape cartridges) having a different thickness is provided with the partially-modified reaction force application portion, the pressing force applied to the tape cartridges can be constant. Accordingly, the positioned states of the tape cartridges can be secured regardless of the thicknesses of the tape cartridges.

In addition, the cartridge casing preferably includes two casings having a split structure, and the reaction force application portion is preferably provided on one of the two casings.

According to this configuration, in a case in which a general tape cartridge having the same shape exists, the tape cartridge including a reaction force application portion can be easily manufactured only by modifying the design of one of the casings.

Moreover, the reaction force application portion is preferably disposed inside an outer contour line of the cartridge casing at a face of the cartridge casing facing the pressing portion when the tape cartridge is installed and an opening/closing cover closes the cartridge installation portion.

According to this configuration, the presence or absence of the reaction force application portion in the cartridge casing has no impact on the installation of the cartridge casing in the specific tape printing apparatus. Accordingly, both of a tape cartridge including a reaction force application portion and a tape cartridge including no reaction force application portion can be used in a specific tape printing apparatus, and thus user's convenience is not spoiled.

DETAILED DESCRIPTION OF THE EMBODIMENTS

Hereinafter, with reference to the accompanying drawings, a description will be given of a tape cartridge according to an embodiment of the present invention in conjunction with a tape printing apparatus in which the tape cartridge is installed. The tape printing apparatus is used to perform printing while feeding out a printing tape and an ink ribbon from the installed tape cartridge and cut off a printed part of the printing tape to create a label (tape piece).

[Outline of Tape Printing Apparatus]

Figure 1:
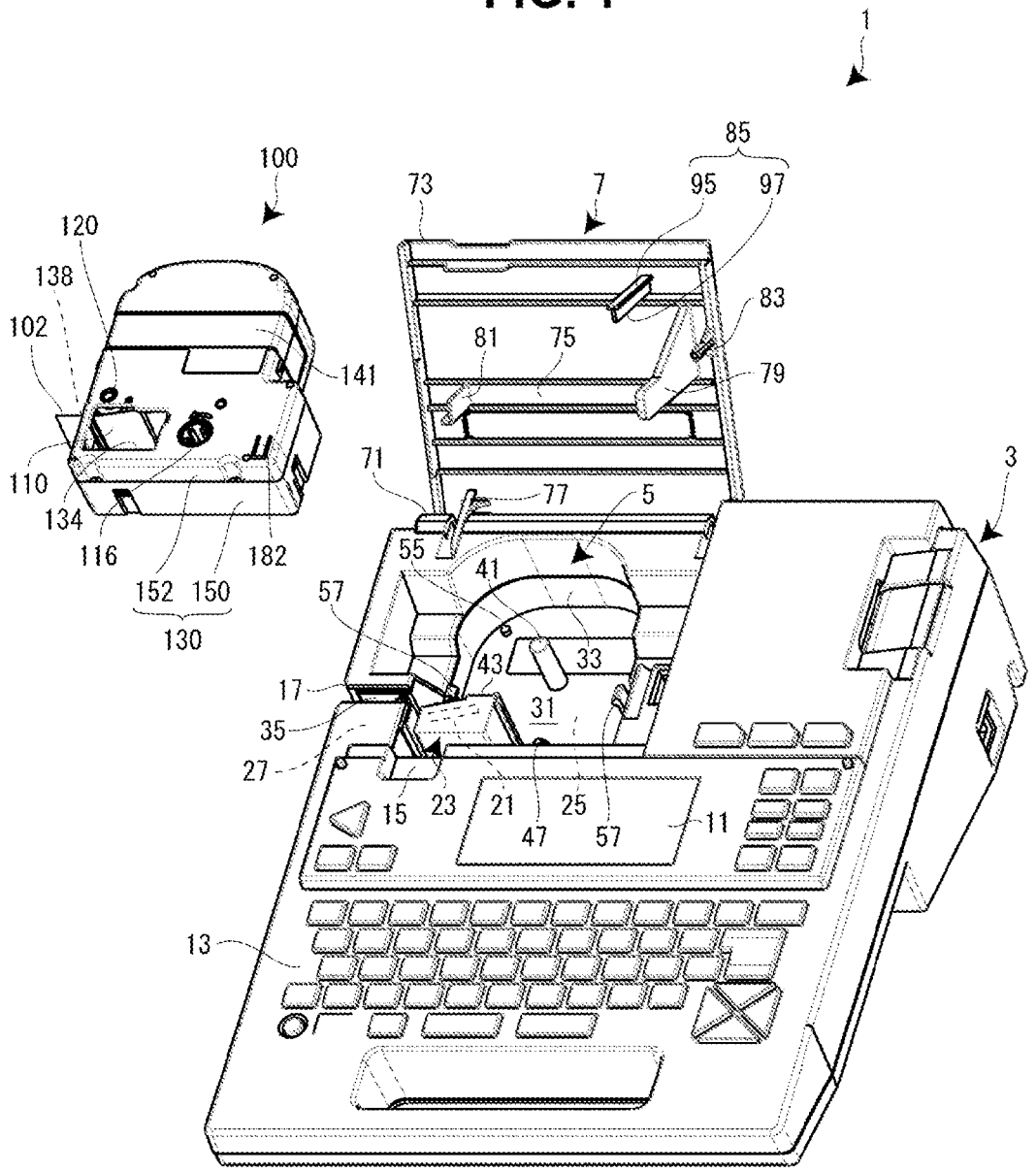
FIG. 1 is an external perspective view of a tape printing apparatus according to an embodiment with its cover opened.

FIG. 1 is an external perspective view of the tape printing apparatus and the tape cartridge installed in the tape printing apparatus. As shown in the figure, a tape printing apparatus 1 includes an apparatus casing 3 constituting an outer shell, a cartridge installation portion 5 on which a tape cartridge 100 is detachably installed, and an opening/closing cover 7 that opens/closes the cartridge installation portion 5. On the upper surface of the apparatus casing 3, the cartridge installation portion 5 is provided on the back side, a display 11 is provided on the central side, and a keyboard 13 is provided on the near side. In the vicinity of the opening/closing cover 7, a finger-hooking recessed portion 15 is provided. The opening/closing cover 7 is opened when the recessed portion 15 is hooked and raised by a finger. Further, on the side surface (left side surface) of the apparatus casing 3, an elongated tape ejection port 17 is provided to eject a printing tape 102.

In addition, the tape printing apparatus 1 includes a printing mechanism portion 23 having a printing head 21 provided to stand on the cartridge installation portion 5, a tape feeding mechanism portion 25 embedded in the back side space of the cartridge installation portion 5, and a tape cutting mechanism portion 27 embedded in the vicinity of the tape ejection port 17. A user enters printing information via the keyboard 13 and performs printing with a key operation after confirming the printing information on the display 11. Upon the printing instruction, the tape feeding mechanism portion 25 is driven to make the printing tape 102 and the ink ribbon 110 run parallel to each other. Moreover, by heat applied from the printing mechanism portion 23 to the ink ribbon 110, the ink of the ink ribbon 110 is heat-transferred to the printing tape 102 to perform the printing. By the print feeding, the printing tape 102 is ejected from the tape ejection port 17. When the printing is completed, the tape cutting mechanism portion 27 is driven to cut off a printed part of the printing tape 102.

[Outline of Tape Cartridge]

As shown in FIGS. 2A and 2B and FIGS. 5A and 5B, the tape cartridge 100 includes a tape roll 106 in which the printing tape 102 is wound on a tape core 104 and a ribbon roll 114 in which the ink ribbon 110 is wound on a feeding-out core 112. In addition, the tape cartridge 100 includes a winding-up core 116 that winds up the ink ribbon 110 that has been consumed and a platen roller 120 (platen) that comes in contact with the printing head 21 and feeds the printing tape 102 and the ink ribbon 110. Moreover, the tape cartridge 100 includes a cartridge casing 130 that accommodates the tape roll 106, the ribbon roll 114, the winding-up core 116, and the platen roller 120. As described above, the tape cartridge 100 of this embodiment has so-called a shell structure in which the outer shell is covered with the cartridge casing 130.

Further, the tape cartridge 100 includes an insertion opening 134 that is provided on the cartridge casing 130 and in which the printing head 21 is inserted. Furthermore, the tape cartridge 100 includes a tape delivering port 138 that is provided on the cartridge casing 130 and from which the printing tape 102 is delivered. Note that as will be described in detail later, the tape roll 106 is rotatably supported by a cylindrical core shaft 192 projecting inside the cartridge casing 130.

When the platen roller 120 and the winding-up core 116 are driven by the tape feeding mechanism portion 25, the printing tape 102 is fed out from the tape core 104 and the ink ribbon 110 is fed out from the feeding-out core 112. The fed-out printing tape 102 and the ink ribbon 110 run parallel to each other at the platen roller 120 and are subjected to printing by the printing head 21. A fed-out end (printed part) of the printing tape 102, on which the printing has been performed, is delivered from the tape delivering port 138 to the tape ejection port 17. On the other hand, the ink ribbon 110 goes around the peripheral wall portion of the insertion opening 134 and is wound up by the winding-up core 116. Note that a plurality of types of tape cartridges having a different thickness is available as the tape cartridge 100 according to a tape width of the printing tape 102.

[Details of Tape Printing Apparatus]

Figure 3:
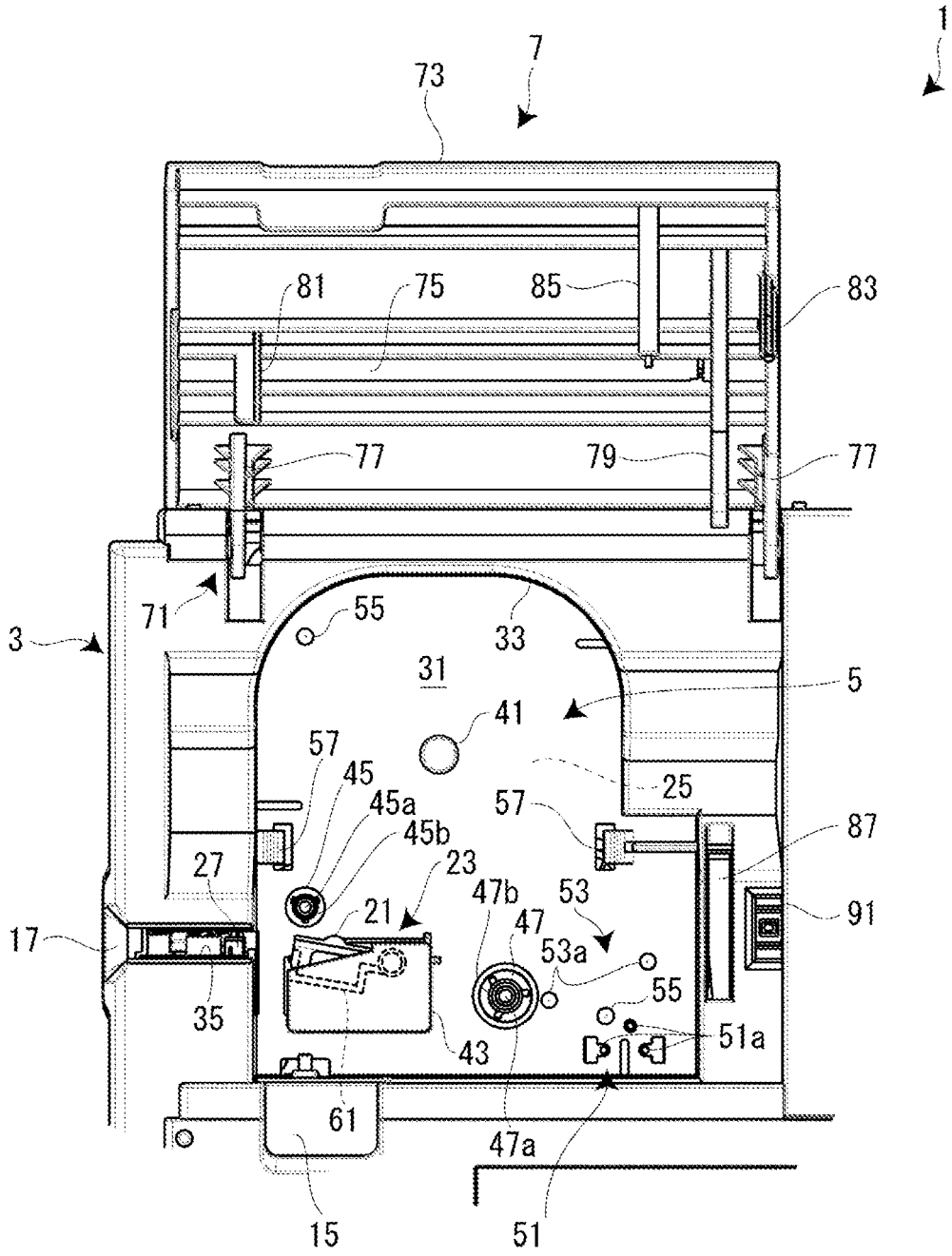
FIG. 3 is a top view of a cartridge installation portion.

As shown in FIG. 1 and FIG. 3, the cartridge installation portion 5 is formed in a flat shape complementary to the flat shape of the tape cartridge 100 and formed to be recessed with a depth corresponding to the tape cartridge 100 having a maximum thickness. In this case, an installation base 31 constituting the bottom plate portion of the cartridge installation portion 5 and a side plate portion 33 are integrally formed (molded) by a resin or the like. A slit-shaped tape ejection path 35 is formed between the cartridge installation portion 5 and the tape ejection port 17, and the tape cutting mechanism portion 27 is embedded at this part.

On the installation base 31 of the cartridge installation portion 5, a positioning projection 41 in which the core shaft 192 of the tape cartridge 100 fits to be positioned, the printing head 21 covered with a head cover 43, a platen driving shaft 45 that rotates and drives the platen roller 120, and a winding-up driving shaft 47 that rotates and drives the winding-up core 116 are provided to stand. In addition, on the installation base 31, a detection portion 51 that detects a type (attribute information) of the printing tape 102 and a core releasing portion 53 that releases the rotation-stop of the feeding-out core 112 and the winding-up core 116 are provided in the vicinity of the winding-up driving shaft 47.

Moreover, on the installation base 31, a pair of small projections 55 is provided at the diagonal positions, and a pair of retaining pieces 57 that retain the intermediate portion of the installed tape cartridge 100 is provided. Further, in the back side space of the installation base 31, the tape feeding mechanism portion 25 constituted of a motor, a gear train (each not shown), or the like that rotates the platen driving shaft 45 and the winding-up driving shaft 47 is embedded. The tape feeding mechanism portion 25 branches power with the gear train and causes the platen driving shaft 45 and the winding-up driving shaft 47 to rotate in synchronization with each other.

The printing mechanism portion 23 includes the printing head 21 constituted of a thermal head and a head supporting frame 61 that supports and rotates the printing head 21. In addition, the printing mechanism portion 23 includes a head releasing mechanism (not shown) that rotates the printing head 21 between a printing position and a retracting position via the head supporting frame 61 and the head cover 43 that covers the printing head 21 (and the head supporting frame 61).

The head releasing mechanism operates as the opening/closing cover 7 is opened/closed. The head releasing mechanism moves (rotates) the printing head 21 to the printing position according to the closing operation of the opening/closing cover 7 and moves (rotates) the printing head 21 to the retracting position according to the opening operation thereof. The printing head 21 comes in contact with the platen roller 120 when moving to the printing position and separates from the platen roller 120 when moving to the retracting position. Thus, the printing tape 102 and the ink ribbon 110 are prevented from interfering with the printing head 21 when the tape cartridge 100 is attached/detached.

The printing head 21 is provided with a plurality of heat generation elements, and the plurality of heat generation elements lines up in the same direction as the shaft direction of the platen roller 120. Further, printing is performed when the printing tape 102 and the ink ribbon 110 are fed and the plurality of heat generation elements is selectively driven. The head cover 43 is formed in a substantially rectangle shape in plan view and integrally formed (molded) with the installation base 31 (the cartridge installation portion 5). In addition, the head cover 43 vertically projects from the installation base 31. The head cover 43 internally allows the rotation of the printing head 21 and externally functions as an installation guide for the tape cartridge 100.

The detection portion 51 is constituted of a plurality of micro switches 51*a*, selectively engages with a detected portion 180 of the tape cartridge 100 that will be described later, and detects a type such as a tape width, a tape color, and a material of the printing tape 102. Further, based on the detection result, the driving of the printing head 21 and the tape feeding mechanism portion 25 is controlled. The core releasing portion 53 is constituted of two releasing pins 53*a* for the feeding-out core 112 and the winding-up core 116. As will be described in detail later, the cartridge casing 130 is provided with rotation-stop hooks 206 retained by the feeding-out core 112 and the winding-up core 116, respectively (see FIG. 6). When the tape cartridge 100 is installed, the releasing pins 53*a* engage with the rotation-stop hooks 206 to release the rotation-stop of the feeding-out core 112 and the winding-up core 116.

The platen driving shaft 45 includes a fixation shaft 45*a* in which the platen roller 120 is inserted and a spline-shaped movable shaft 45*b* rotatably journaled in the base portion of the fixation shaft 45*a*. The rotation power of the tape feeding mechanism portion 25 is transmitted to the movable shaft 45*b* and then transmitted from the movable shaft 45*b* to the platen roller 120. Similarly, the winding-up driving shaft 47 includes a fixation shaft 47*a* and a spline-shaped movable shaft 47*b* rotatably journaled in the fixation shaft 47*a*. In this case as well, the rotation power of the tape feeding mechanism portion 25 is transmitted to the movable shaft 47*b* and then further transmitted from the movable shaft 47*b* to the winding-up core 116.

When the tape cartridge 100 is installed on the cartridge installation portion 5, the core shaft 192 (the tape core 104) engages with the positioning projection 41, the platen roller 120 engages with the platen driving shaft 45, and the winding-up core 116 engages with the winding-up driving shaft 47. Then, when the opening/closing cover 7 is closed, the printing head 21 rotates and comes in contact with the platen roller 120 with the printing tape 102 and the ink ribbon 110 held therebetween, which brings the tape printing apparatus 1 in a printing standby state.

Figure 4:
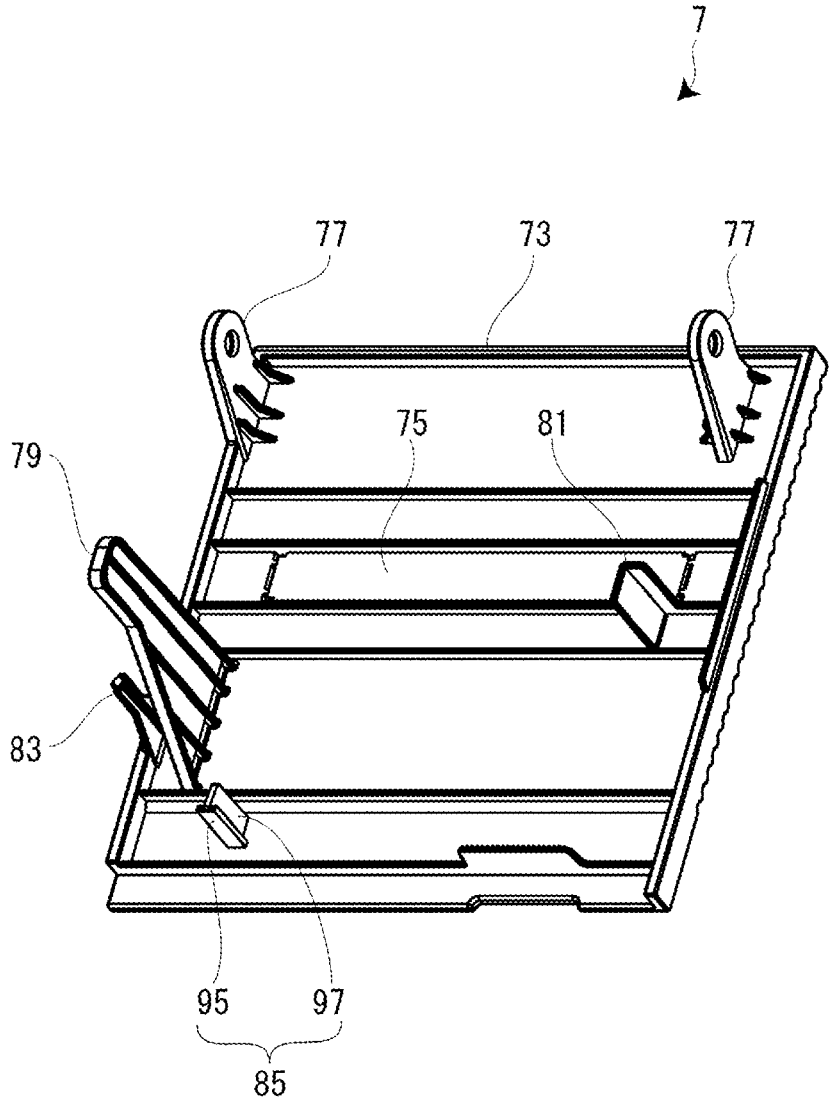
FIG. 4 is a perspective view of the opening/closing cover when seen from the side of its rear surface.

As shown in FIG. 1 and FIG. 4, the opening/closing cover 7 is rotatably, i.e., openably/closably attached to the apparatus casing 3 via a hinge portion 71 provided on the back side. The opening/closing cover 7 includes an opening/closing cover main body 73 formed in a rectangle shape in plan view, a check window 75 provided at the center of the opening/closing cover main body 73, and a pair of journaled pieces 77 that projects from the rear surface of the opening/closing cover main body 73 and is rotatably journaled in the hinge portion 71. In addition, the opening/closing cover 7 includes an operation lever 79 that projects from the rear surface of the opening/closing cover main body 73 and rotates the printing head 21 and a pressing projection 81 that projects from the rear surface of the opening/closing cover main body 73 and presses the tape cartridge 100. Moreover, the opening/closing cover 7 includes a pressing projection 83 that projects from the rear surface of the opening/closing cover main body 73 and operates (turns ON) an embedded cover closing detection switch (not shown) and a pressing portion 85 that projects from the rear surface of the opening/closing cover main body 73 and presses an elastic portion 182, which will be described later, of the tape cartridge 100.

The check window 75 is formed to be long from side to side and made of a transparent (visible-light transparent) resin formed separately from the opening/closing cover main body 73. Through the check window 75, (a type and a tape remaining amount of the printing tape 102 of) the tape cartridge 100 installed on the cartridge installation portion 5 can be visually checked. In addition, the pair of journaled pieces 77, the operation lever 79, the pressing projection 81, the pressing projection 83, and the pressing portion 85 are integrally formed (molded) with the opening/closing cover main body 73 by a resin.

The operation lever 79 projects from the rear surface of the opening/closing cover main body 73 and is inserted in a slit opening 87 provided on the lateral side of the cartridge installation portion 5 as the opening/closing cover 7 is closed. The operation lever 79 inserted in the slit opening 87 causes the head releasing mechanism described above to operate and the printing head 21 to rotate toward the platen roller 120. Similarly, as the opening/closing cover 7 is closed, the pressing projection 83 is inserted in a rectangle opening 91 adjacent to the slit opening 87 and operates (for example, turns "ON") the cover closing detection switch. The pressing projection 81 is positioned so as to be in the vicinity of the platen roller 120 of the tape cartridge 100 and presses, as the opening/closing cover 7 is closed, the tape cartridge 100 so as to be set on the installation base 31 of the cartridge installation portion 5.

The pressing portion 85 is disposed in the vicinity of the operation lever 79 and vertically projects from the rear surface of the opening/closing cover main body 73. In addition, the pressing portion 85 is formed in a "T"-shape in cross section and disposed with a flange piece 95 directed to the side of the tip end of the opening/closing cover main body 73 and a rib piece 97 directed to the side of the base end of the opening/closing cover main body 73 (which will be described in detail later).

[Details of Tape Cartridge]

Next, a description will be given in detail of the tape cartridge 100 with reference to FIGS. 2A and 2B, FIGS. 5A and 5B, and FIG. 6. Note that in the description of the tape cartridge 100, a surface on the near side in the installation direction, i.e., on the upper front side of the tape cartridge 100 will be called a "front surface" and a surface on the back side in the installation direction, i.e., on the opposite side of the tape cartridge 100 will be called a "rear surface" taking FIGS. 2A and 2B as an example. In addition, taking FIGS. 2A and 2B as an example, a side surface on the left side of the tape cartridge 100 will be called a "left side surface," a side surface on the right side thereof will be called a "right side surface," an arc-shaped side surface on the upper side thereof will be called a "tip end surface," and a side surface on the lower side thereof will be called a "base end surface."

As described above, the tape cartridge 100 includes the cartridge casing 130 and the tape roll 106, the ribbon 114, the winding-up core 116, and the platen roller 120 accommodated in the cartridge casing 130. In addition, the tape cartridge 100 includes the insertion opening 134 provided on the cartridge casing 130, the tape delivering port 138 formed on the left side surface in the vicinity of the platen roller 120, and an identification label 141 (see FIG. 1) affixed from the left side surface to the right side surface via the front surface at a position at which the tape roll 106 is accommodated. On the identification label 141, a tape width, a tape color, a material, and the like of the printing tape 102 accommodated in the cartridge casing 130 are displayed by characters at the two places of the front surface and the left side surface.

The cartridge casing 130 constitutes the outer shell of the tape cartridge 100 (the shell structure) and has an appearance that is formed in an "L"-shape in plan view and of which the base end at the right side surface slightly projects. In the front and rear direction, the cartridge casing 130 is constituted of a lower casing 150 and an upper casing 152, the lower casing 150 and the upper casing 152 being positioned on the back side and the near side, respectively, when the cartridge casing 130 is installed on the cartridge installation portion 5. In the cartridge casing 130 of the embodiment, the upper casing 152 is constituted of a resin molded item transparent to an extent that the visual checking of the accommodated printing tape 102 is allowed, and the lower casing 150 is constituted of a non-transparent resin molded item. As the tape cartridge, a plurality of types of tape cartridges having a different thickness is available as described above. The difference in the thickness is adjusted by the lower casing 150, and the upper casing 152 is used as a common constituent.

The upper casing 152 is such that a top wall portion 156 constituting the front surface of the cartridge casing 130 and an upper peripheral wall portion 158 suspending on the periphery of the top wall portion 156 are integrally formed (molded). In addition, the lower casing 150 is such that a bottom wall portion 160 constituting the rear surface of the cartridge casing 130, a lower peripheral wall 162 provided to stand on the periphery of the bottom wall portion 160, and an opening peripheral wall portion 164 provided to stand on the bottom wall portion 160 so as to define the insertion opening 134 are integrally formed (molded).

On the lower end surface of the upper peripheral wall portion 158 of the upper casing 152, a plurality of joining pins 170 is provided at appropriate intervals. While, on the lower peripheral wall 162 of the lower casing 150, a plurality of joining holes 172 is provided corresponding to the plurality of joining pins 170 (see FIGS. 5A and 5B). After constituents such as the tape roll 106 and the ribbon roll 114 are disposed on the lower casing 150, the upper casing 152 is joined to the lower casing 150 so as to press-fit the plurality of joining pins 170 in the plurality of joining holes 172, whereby the tape cartridge 100 is assembled. Note that the respective joining holes 172 are formed as through holes from the viewpoint of molding easiness.

Figure 2A:
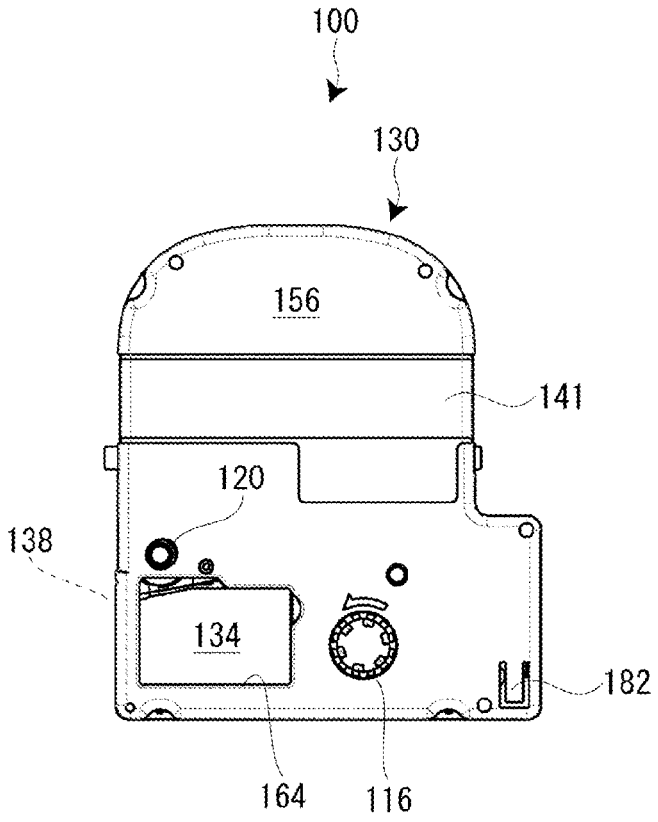
FIGS. 2A and 2B are, respectively, a plan view and a side surface view of a tape cartridge according to the embodiment.
Figure 2B:
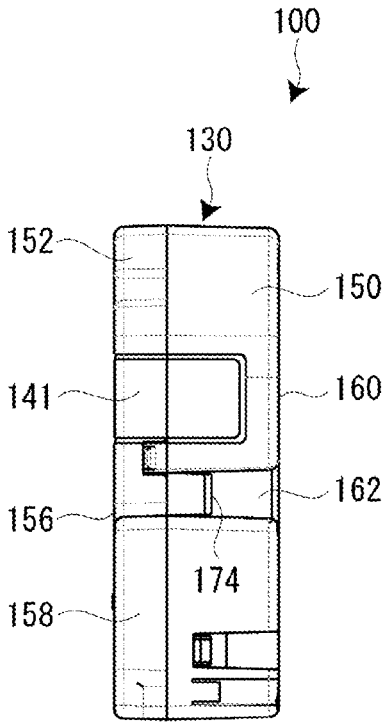
Figure 6:
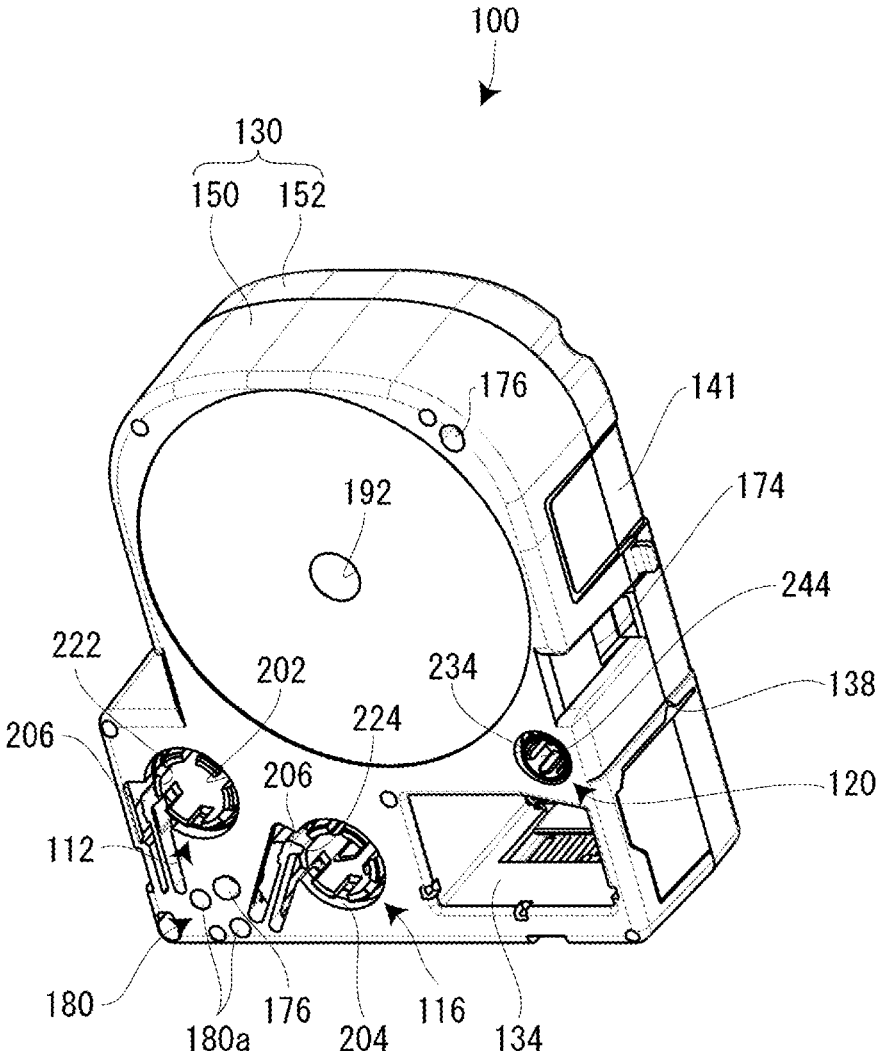
FIG. 6 is a perspective view of the tape cartridge when seen from the side of its rear surface.

On the other hand, on the left side surface and the right side surface of the lower casing 150, a pair of retaining-reception portions 174 retained by the pair of retaining pieces 57 is provided (see FIGS. 2A and 2B and FIG. 6). When the pair of retaining-reception portions 174 of the installed tape cartridge 100 is retained by the pair of retaining pieces 57 on the side of the cartridge installation portion 5, the tape cartridge 100 is prevented from floating. In addition, on the rear surface of the lower casing 150, small fitting holes 176 in which the pair of small projections 55 fits with slight room are provided (see FIG. 6). When the pair of small projections 55 on the side of the cartridge installation portion 5 fits in the small fitting holes 176, the tape cartridge 100 is easily positioned on the installation base 31.

Moreover, on the rear surface of the lower casing 150, the detected portion 180 corresponding to the detection portion 51 is provided at a left corner part on the side of the base end surface (i.e., at a right corner part as seen from the side of the front surface) (see FIG. 6). The detected portion 180 is constituted at a portion corresponding to the plurality of micro switches 51*a* of the detection portion 51, and a plurality of bit patterns is obtained based on the presence or absence of reception holes 180*a* provided at the portion. That is, the bit patterns correspond to a type of the printing tape 102.

On the other hand, at a right corner part on the side of the base end surface on the front surface of the tape cartridge 100, i.e., at a right corner part on the side of the base end surface on the front surface of the upper casing 152, the elastic portion 182 with which the pressing portion 85 comes in contact is provided (see FIGS. 2A and 2B and FIGS. 5A and 5B). As will be described in detail later, the pressing portion 85 provided on the opening/closing cover 7 presses the elastic portion 182 of the tape cartridge 100 when the opening/closing cover 7 is closed. The pressed elastic portion 182 is elastically deformed, and the tape cartridge 100 itself is pressed to the cartridge installation portion 5 (the installation base 31) by an elastic force resulting from the elastic deformation.

As shown in FIG. 5, in upper side space (on the side of the tip end surface) inside the cartridge casing 130, a tape accommodation area 190 in which the tape roll 106 is widely accommodated is constituted. At the center of the tape accommodation area 190, the core shaft 192 integrally formed (molded) with the lower casing 150 is provided to stand. The core shaft 192 is formed in a cylindrical shape, and the tape roll 106 (the tape core 104) is rotatably journaled in the outer peripheral surface of the core shaft 192. In addition, in the tape accommodation area 190, a tape guide 194 that guides the fed-out printing tape 102 to the platen roller 120 is integrally formed with the lower casing 150 so as to stand in the vicinity of the platen roller 120.

That is, inside the cartridge casing 130, a tape feeding path 196 ranging from the tape roll 106 as a starting point to the tape delivering port 138 via the tape guide 194 and the platen roller 120 is constituted. The printing tape 102 fed out from the tape roll 106 is guided to the platen roller 120 via the tape guide 194 and subjected to printing by the platen roller 120. Then, the printing tape 102 is further guided from the platen roller 120 to the tape delivering port 138.

The tape roll 106 includes two films 198 affixed to both end surfaces of the roll-shaped printing tape 102, besides the printing tape 102 and the tape core 104. The two films 198 prevent the printing tape 102 wound on the tape core 104 from spreading out. In addition, although not shown in the figures, a reverse-rotation stop mechanism is embedded in the tape core 104. When the tape cartridge 100 is carried, the reverse rotation of the printing tape 102 is prevented by the reverse-rotation stop mechanism. On the other hand, when the tape cartridge 100 is installed on the cartridge installation portion 5, the reverse-rotation stop of the reverse-rotation stop mechanism is released by the positioning projection 41, whereby the feeding of the printing tape 102 is made possible.

On the right side of a base portion inside the cartridge casing 130, a ribbon accommodation area 200 is constituted adjacent to the insertion opening 134. In the ribbon accommodation area 200, a feeding-out-side bearing portion 202 that rotatably supports the ribbon roll 114 (the feeding-out core 112) and a winding-up-side bearing portion 204 that rotatably supports the winding-up core 116 are integrally formed with the cartridge casing 130 to the right and left parts, respectively. That is, the feeding-out-side bearing portion 202 and the winding-up-side bearing portion 204 are formed on each of the upper casing 152 and the lower casing 150.

The notched parts of the feeding-out-side bearing portion 202 and the winding-up-side bearing portion 204 formed on the lower casing 150 are each integrally formed with the rotation-stop hooks 206 having the tip end thereof facing the feeding-out-side bearing portion 202 and the winding-up-side bearing portion 204. Further, one and the other of rotation-stop hooks 206 engage with the feeding-out core 112 and the winding-up core 116, respectively, in their rotation stopping state.

In the ribbon accommodation area 200, a first ribbon guide 210 that guides the fed-out ink ribbon 110 to the platen roller 120 is integrally formed with the lower casing 150 so as to stand in the vicinity of the feeding-out-side bearing portion 202. In addition, on the outer peripheral side of the opening peripheral wall portion 164, a plurality of second ribbon guides 212 that guides the going-around of the ink ribbon 110 is integrally formed.

That is, inside the cartridge casing 130, a ribbon feeding path 214 ranging from the ribbon roll 114 as a starting point to the winding-up core 116 via the first ribbon guide 210, the platen roller 120, and the plurality of second ribbon guides 212 is constituted. The ink ribbon 110 fed out from the ribbon roll 114 is guided to the platen roller 120 via the first ribbon guide 210 and subjected to printing by the platen roller 120. Moreover, the ink ribbon 110 goes around the opening peripheral wall portion 164 (the plurality of second ribbon guides 212) via the platen roller 120 and is wound up by the winding-up core 116.

Figure 5A:
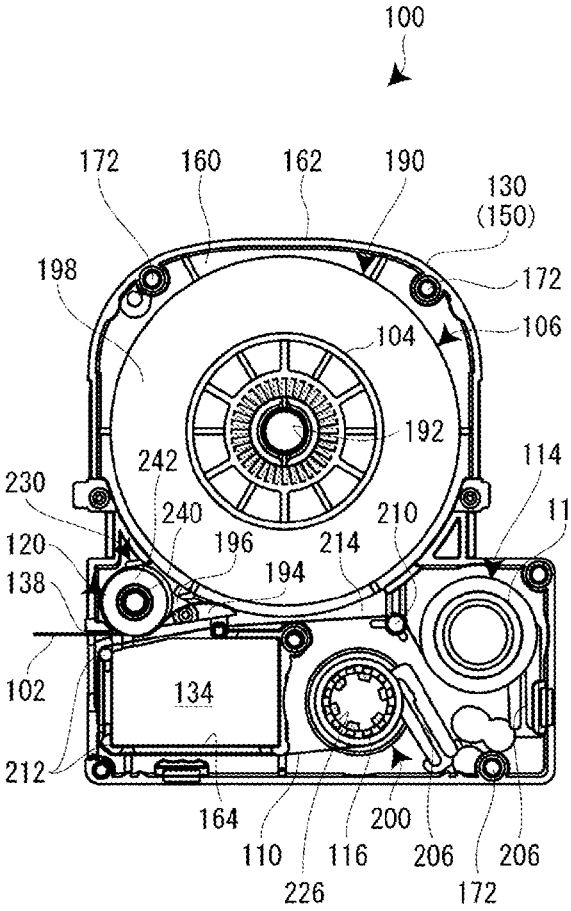
FIGS. 5A and 5B are, respectively, a plan view of the tape cartridge with its upper casing removed and a rear surface view of the upper casing.
Figure 5B:
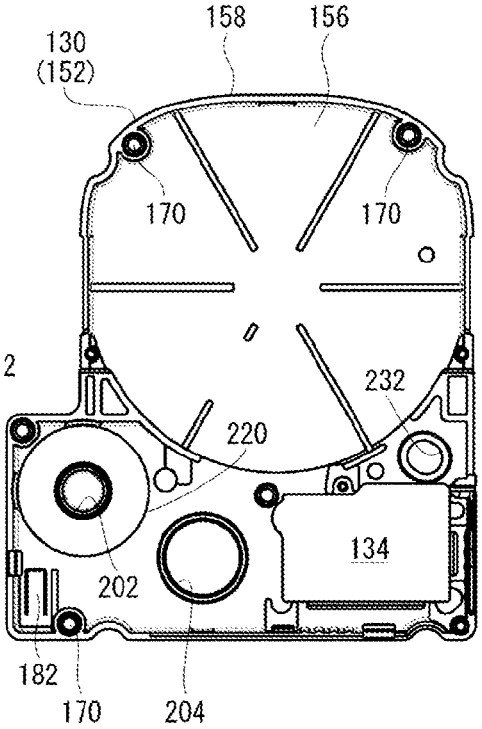

The ribbon roll 114 includes a circular leaf spring 220 that applies a braking load to the feeding-out core 112, besides the ink ribbon 110 and the feeding-out core 112 (see FIG. 5B). The leaf spring 220 is formed to be wavy in the peripheral direction and interposed between the top wall portion 156 of the upper casing 152 and the feeding-out core 112 in the shaft direction. That is, a rotation braking load is applied to the feeding-out core 112 by the elastic force of the leaf spring 220. Thus, back tension is applied to the ink ribbon 110 fed out from the winding-up core 116 to prevent slack in the ink ribbon 110.

The feeding-out core 112 is formed in a cylindrical shape, and a plurality of notches 222 is formed in the peripheral direction at the end thereof on the side of the lower casing 150 (see FIG. 6). Further, the rotation-stop hooks 206 engage with or disengage from the plurality of notches 222. Note that the feeding-out-side bearing portion 202 on the side of the lower casing 150 supporting the feeding-out core 112 is constituted of a circular opening while the feeding-out-side bearing portion 202 on the side of the upper casing 152 is constituted of a cylindrical projection portion. Further, the leaf spring 220 is attached to the projection portion (see FIG. 5B about both of the constituents).

Similarly, the winding-up core 116 is formed in a cylindrical shape, and a plurality of notches 224 is formed in the peripheral direction at the end thereof on the side of the lower casing 150. Further, the rotation-stop hooks 206 engage with or disengage from the plurality of notches 224. In addition, a spline groove 226 is formed on the inner peripheral surface of the winding-up core 116 and spline-engages with the winding-up driving shaft 47. Thus, the rotation force of the winding-up driving shaft 47 is transmitted to the winding-up core 116 to wind up the ink ribbon 110.

On the left side of the base portion inside the cartridge casing 130, a platen accommodation area 230 is constituted adjacent to the insertion opening 134. At the center of the platen accommodation area 230, a lower bearing portion 234 (see FIG. 6) having an elliptical opening formed on the lower casing 150 and an upper bearing portion 232 (see FIG. 5B) having an elliptical opening formed on the upper casing 152 are provided. Further, by the upper bearing portion 232 and the lower bearing portion 234, the platen roller 120 is supported so as to be rotatable and slightly movable (horizontally movable). That is, the platen roller 120 supported by the elliptical upper bearing portion 232 and the lower bearing portion 234 is configured to be movable (slightly movable) between a home position at which the platen roller 120 engages with the platen driving shaft 45 and a holding position at which the platen roll 120 comes in contact with the tape guide 194 with the printing tape 102 held therebetween.

Meanwhile, when the tape cartridge 100 is carried, the fed-out end of the printing tape 102 is in a state of slightly projecting from the tape delivering port 138 to an outside (see FIG. 1). If a pressing force or a withdrawing force is falsely applied to the fed-out end of the printing tape 102 at this time, the platen roller 120 pulled by the force is moved to the holding position described above. Thus, the fed-out end of the printing tape 102 is prevented from being withdrawn into the cartridge casing 130 via the tape delivering port 138.

The platen roller 120 includes a cylindrical roller base body 240 and a rubber roller 242 attached to the outer peripheral surface of the roller base body 240. The rubber roller 242 has a length corresponding to the printing head 21 in the shaft direction, and the printing head 21 comes in contact with the rubber roller 242 with the printing tape 102 and the ink ribbon 110 held therebetween when moving to a printing position. In addition, a spline groove 244 is formed on the inner peripheral surface of the roller base body 240 and spline-engages with the platen driving shaft 45. Thus, the rotation force of the platen driving shaft 45 is transmitted to the platen roller 120 to print-feed the printing tape 102 (and the ink ribbon 110).

Elastic Portion and Pressing Portion

First Embodiment

Next, with reference to FIGS. 7A to 7C, a description will be given in detail of the structure of the elastic portion 182 of the tape cartridge 100 according to a first embodiment in conjunction with the structure of the pressing portion 85 of the opening/closing cover 7. As described above, the elastic portion 182 (a reaction force application portion) is provided at the right corner part on the near side of the top wall portion 156 of the upper casing 152, and the pressing portion 85 corresponding to the elastic portion 182 is provided so as to project from the rear surface of the opening/closing cover 7 (the opening/closing cover main body 73).

Figure 7A:
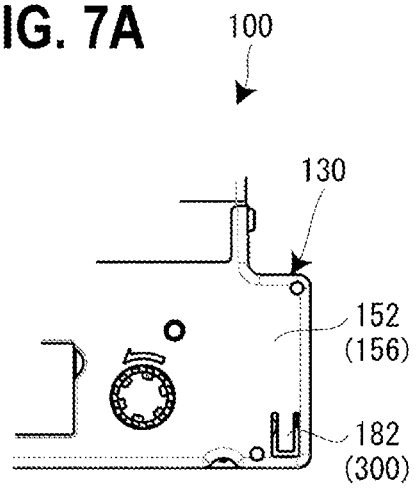
FIGS. 7A to 7C are, respectively, an enlarged plan view in the vicinity of the elastic portion of the tape cartridge according to a first embodiment, an enlarged perspective view in the vicinity of a pressing portion, and a cross-sectional view in a state in which the elastic portion is pressed by the pressing portion.

As shown in FIG. 7A, the elastic portion 182 includes an elastic piece 300 formed by linearly cutting off the top wall portion 156 (a casing wall), and the elastic piece 300 of the first embodiment is formed as a rectangle portion obtained by cutting off the top wall portion 156 into a "U"-shape. On the front surface of the upper casing 152, the elastic piece 300 is disposed at the corner part at which the right side surface and the base end surface cross each other and extends in parallel with the right side surface and from the tip end side to the near side of the upper casing 152. The width and the length of the elastic piece 300 are designed such that the elastic piece 300 shows an appropriate elastic force when being deformed by the pressing portion 85.

Figure 7B:
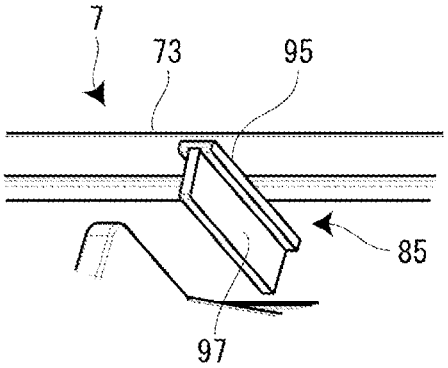
Figure 7C:
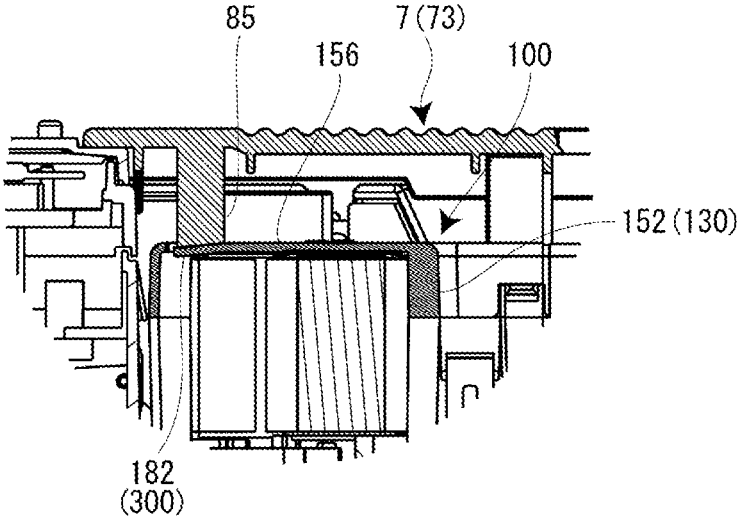

As shown in FIG. 7C, the elastic piece 300 is displaced by the pressing force of the pressing portion 85 when the opening/closing cover 7 is closed and applies a reaction force, which is increased (preferably proportionally increased) with the displacement amount, to the pressing portion 85. In other words, with the pressing portion 85 as a reception portion, the tape cartridge 100 is pressed to the installation base 31 via the elastic piece 300 of its own. Therefore, the elastic force of the elastic piece 300 is set such that the tape cartridge 100 is positioned on the installation base 31 in the installation direction.

More specifically, the tape cartridge 100 receives the pressing force of the printing head 21 via the platen roller 120 and receives rotation forces around the platen roller 120 and the winding-up core 116 with the rotations of the platen roller 120 (the platen driving shaft 45) and the winding-up core 116 (the winding-up driving shaft 47). Therefore, since the tape cartridge 100 receives the resultant of the pressing force and the rotation forces and the component forces thereof, a positional deviation or floating (a floating force) is caused in the tape cartridge 100 on the installation base 31. The elastic force of the elastic piece 300 of the embodiment allows the tape cartridge 100 to be installed at a prescribed position against the resultant and the component forces.

On the other hand, as shown in FIG. 7B, the pressing portion 85 is formed in a "T"-shape in cross section and vertically projects from the rear surface of the opening/closing cover main body 73. The opening/closing cover main body 73 and the pressing portion 85 are integrally molded by a resin or the like, and the "T"-shape in cross section of the pressing portion 85 prevents a molding failure (sink mark). The pressing portion 85 having the "T"-shape in cross section is disposed with the flange piece 95 directed to the side of the tip end of the opening/closing cover main body 73 and the rib piece 97 directed to the side of the base end of the opening/closing cover main body 73. Further, the tip end of the pressing portion 85 is formed in a slant surface following the shape of the deformed elastic piece 300, and the entirety of the tip end presses the elastic piece 300.

As described above, according to the tape cartridge 100 of the first embodiment, the pressing portion 85 elastically deforms the elastic piece 300 when the opening/closing cover 7 is closed. Thus, the tape cartridge 100 is pressed to the installation base 31 (the cartridge installation portion 5) via the elastic piece 300 by the pressing portion 85 while being positioned. Thus, since the elastic portion 182 (the elastic piece 300) that presses and positions the tape cartridge 100 is provided on the tape cartridge 100 as a part of the cartridge casing 130, the positioning structure of the tape cartridge 100 can be extremely simplified. In addition, since the elastic portion 182 is provided on the tape cartridge 100 that is a consumable item, the elastic portion 182 does not require durability. In this regard as well, the structure of the elastic portion 182 can be simplified, and an increase in the cost can be reduced. Moreover, since the elastic piece 300 is provided on the tape cartridge 100 that is a consumable item, the initial elastic force of the elastic portion 182 can be obtained every time the tape cartridge 100 is replaced with a new one. Accordingly, degradation in the elastic force of the elastic portion 182 can be reduced.

On the other hand, the detected portion 180 is positioned right under the elastic portion 182 (see FIG. 6) and strongly pressed by the detection portion 51. Thus, the detection failure of a tape type can be effectively prevented. In addition, the elastic piece 300 is deflected (deformed) in the same direction as the rotation direction of the opening/closing cover 7. Thus, the pressing force applied to the tape cartridge 100 can be secured. Moreover, since the elastic portion 182 is provided on the front surface of the cartridge casing 130, the basic shape of the tape cartridge 100 is not spoiled. Note that although the elastic piece 300 of the embodiment is formed in a simple rectangle, it may be formed in any shape such as a keyhole shape.

Elastic Portion and Pressing Portion

Second Embodiment

Next, with reference to FIGS. 8A to 8C, a description will be given in detail of the structure of an elastic portion 182 of a tape cartridge 100A according to a second embodiment in conjunction with the structure of a pressing portion 85A of an opening/closing cover 7. In addition, portions different from those of the first embodiment will be mainly described in the second embodiment.

Figure 8A:
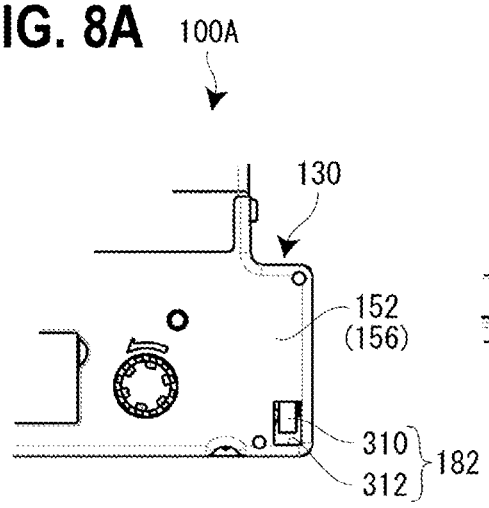
FIGS. 8A to 8C are, respectively, an enlarged plan view in the vicinity of the elastic portion of a tape cartridge according to a second embodiment, an enlarged perspective view in the vicinity of a pressing portion, and a cross-sectional view in a state in which the elastic portion is pressed by the pressing portion.
Figure 8B:
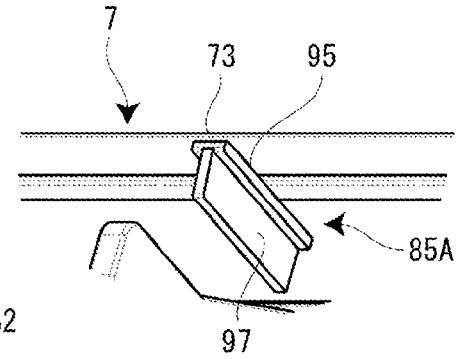
Figure 8C:
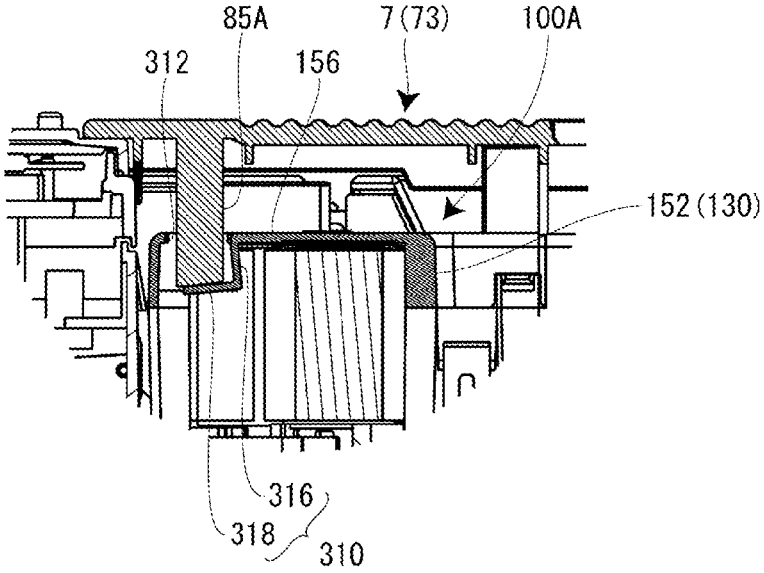

As shown in FIGS. 8A and 8C, the elastic portion 182 of the second embodiment includes an elastic piece 310 that is formed in an "L"-shape in cross section and extends to an inside from a top wall portion 156 of an upper casing 152 and a reception opening 312 that is formed on the top wall portion 156 and receives the pressing portion 85A. The elastic piece 310 includes a suspending piece portion 316 extending from the top wall portion 156 and a contact piece portion 318 against which the pressing portion 85A butts, and is integrally formed (molded) with the upper casing 152. In addition, the elastic piece 310 is formed in a rectangle shape in plan view, while the reception opening 312 is formed in a rectangle shape slightly larger than the elastic piece 310.

As described above, as the tape cartridge 100A, a plurality of types of tape cartridges having a different thickness is available. Therefore, among the tape cartridges 100A having a different thickness, the contact piece portion 318 of the elastic piece 310 is preferably disposed such that the distance between the surface of an installation base 31 and the pressing end of the pressing portion 85A becomes the same. Thus, a pressing force applied to the tape cartridges 100A having a different thickness can be constant.

The pressing portion 85A of the second embodiment has the same shape as that of the pressing portion 85 of the first embodiment (see FIG. 8B) but is formed to be longer than the elastic piece 300 of the first embodiment since the elastic piece 310 is recessed to be formed in an "L"-shape in cross section. Further, when the pressing force of the pressing portion 85A is applied to the elastic piece 310, the suspending piece portion 316 is deflected backward simultaneously with the downward deflection of the contact piece portion 318 to exert an elastic force (spring force).

As described above, in the tape cartridge 100A of the second embodiment as well, the pressing portion 85A elastically deforms the elastic piece 310 when the opening/closing cover 7 is closed. Thus, the tape cartridge 100A is pressed to the installation base (a cartridge installation portion 5) via the elastic piece 310 by the pressing portion 85A while being positioned. In this case, since the elastic piece 310 is formed in the "L"-shape in cross section, a large elastic stroke can be achieved and the positioning of the tape cartridge 100A can be secured.

Modified Example of Second Embodiment

Figure 9A:
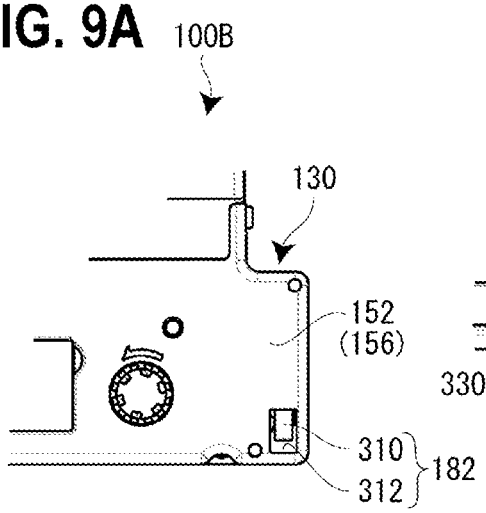
FIGS. 9A to 9C are, respectively, an enlarged plan view in the vicinity of the elastic portion of a tape cartridge according to a modified example of the second embodiment, an enlarged perspective view in the vicinity of a pressing portion, and a cross-sectional view in a state in which the elastic portion is pressed by the pressing portion.
Figure 9B:
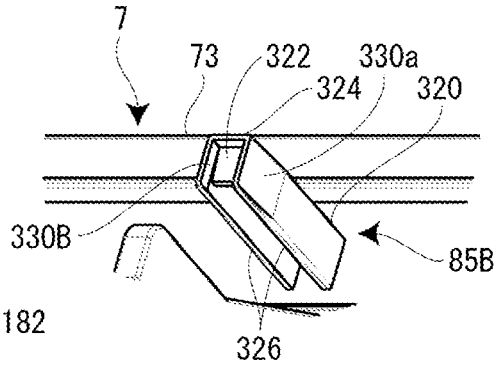
Figure 9C:
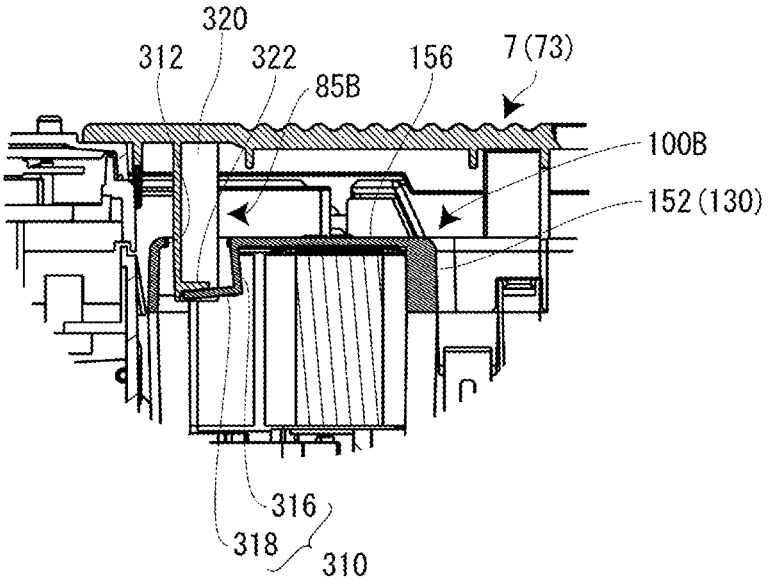

FIGS. 9A to 9C show a tape cartridge 100B according to a modified example of the second embodiment. As shown in the figures, in the modified example, a pressing portion 85B of the opening/closing cover 7 includes a column-shaped projection portion 320 formed in a "U"-shape in cross section and a pressing piece portion 322 provided at the tip end of the column-shaped projection portion 320. The pressing piece portion 322 is integrally formed with the column-shaped projection portion 320 and formed in a plate shape crossing the extending direction of the column-shaped projection portion 320. In addition, the pressing piece portion 322 is disposed at a position slightly away from the tip end of the column-shaped projection portion 320. Further, the pressing piece portion 322 comes in contact with the contact piece portion 318 of the elastic piece 310 to deform the elastic piece 310.

The contour of the column-shaped projection portion 320 is formed in a shape complementary to the reception opening 312, and the column-shaped projection portion 320 fits in the reception opening 312. The column-shaped projection portion 320 formed in the "U"-shape in cross section is disposed with a flange piece 324 directed to the side of the tip end of the opening/closing cover main body 73 and a pair of rib pieces 326 be parallel to the side surfaces of the opening/closing cover main body 73.

In addition, in order to guide the fitting, outer guide slant surfaces 330*a* narrowed toward the tip end are formed on the outer surfaces (three sides) of the tip end of the column-shaped projection portion 320. Similarly, in order to guide the butting of the pressing piece portion 322 to the contact piece portion 318, inner guide slant surfaces 330*b* expanded toward the tip end are formed on the inner surfaces (three sides) of the tip end of the column-shaped projection portion 320.

When the opening/closing cover 7 is closed, the pressing portion 85B fitting in the elastic portion 182 is guided by the outer guide slant surfaces 330*a* to fit in the reception opening 312 while the pressing piece portion 322 is guided by the inner guide slant surfaces 330*b* to butt against the contact piece portion 318. In this state, the three sides on the outside of the column-shaped projection portion 320 come in contact with the corresponding three sides of the reception opening 312, and the tape cartridge 100B is positioned by the pressing portion 85B (the column-shaped projection portion 320) via the reception opening 312. In addition, the three sides on the inside of the tip end of the column-shaped projection portion 320 come in contact with the corresponding three sides of the contact piece portion 318, and the tape cartridge 100B is positioned by the pressing portion 85B (the column-shaped projection portion 320) via the contact piece portion 318.

As described above, in the tape cartridge 100B according to the modified example of the second embodiment, the pressing portion 85B presses the elastic portion 182 to fit therein when the opening/closing cover 7 is closed. Therefore, the tape cartridge 100B is pressed to the installation base 31 to be positioned in the installation direction (the front and rear direction) and positioned in the back and forth and the right and left directions on the installation base 31. Accordingly, a positional deviation in the tape cartridge 100B can be effectively prevented.

Elastic Portion and Pressing Portion

Third Embodiment

Figure 10A:
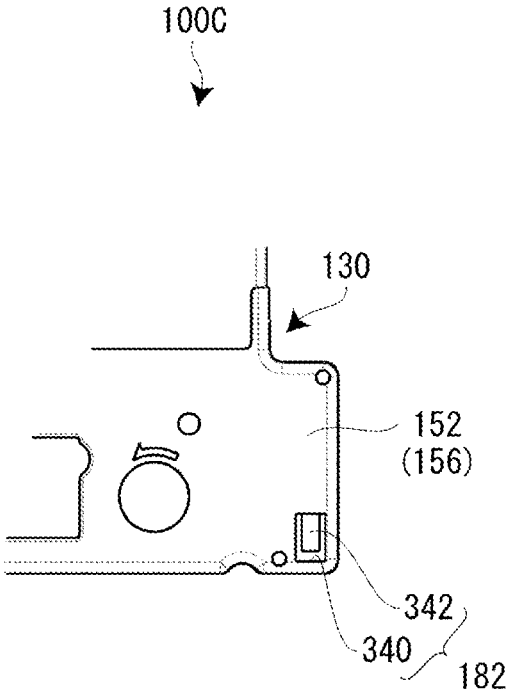
FIGS. 10A and 10B are, respectively, an enlarged plan view in the vicinity of the elastic portion of a tape cartridge according to a third embodiment and a cross-sectional view in the vicinity of the elastic portion.
Figure 10B:
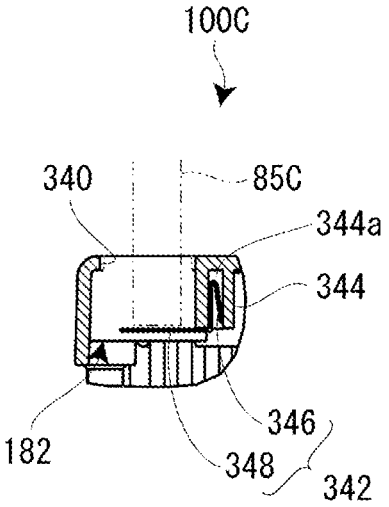

Next, with reference to FIGS. 10A and 10B, a description will be given in detail of the structure of an elastic portion 182 of a tape cartridge 1000 according to a third embodiment in conjunction with the structure of a pressing portion 85C of an opening/closing cover 7. In addition, portions different from those of the first and second embodiments will be mainly described in the third embodiment as well. The elastic portion 182 of the third embodiment includes a reception opening 340 (receiving recessed portion) formed on a top wall portion 156 of an upper casing 152, an elastic member 342 disposed inside the top wall portion 156 so as to face the reception opening 340, and a holding portion 344 that projects inside the top wall portion 156 and holds the elastic member 342 with the base end side thereof.

The elastic member 342 is constituted of a leaf spring including a base spring piece portion 346 folded into a "V"-shape and a contact spring piece portion 348 extending from the base spring piece portion 346 in parallel with the top wall portion 156. The base spring piece portion 346 exerts a spring force for holding the elastic member 342 itself at the holding portion 344, and the contact spring piece portion 348 exerts a spring force for pressing the tape cartridge 100C.

The holding portion 344 is constituted of an inward projection portion having a slit-shaped holding groove 344*a* at the center thereof. The elastic member 342 is held by the holding portion 344 with the base spring piece portion 346 elastically fitting in the holding groove 344*a*. The reception opening 340 has the same shape as that of the reception opening 312 of the second embodiment. In addition, the pressing portion 85C has the same shape as those of the pressing portions 85 and 85A of the first and second embodiments. Note that the pressing portion 85C may have a positioning function like the pressing portion 85B of the modified example of the second embodiment.

In the tape cartridge 100C of the third embodiment as described above, the pressing portion 85C also elastically deforms the elastic member 342 when the opening/closing cover 7 is closed. Thus, the tape cartridge 100C is pressed to an installation base 31 (a cartridge installation portion 5) via the elastic member 342 by the pressing portion 85C while being positioned. In this case, since the elastic member 342 is constituted of the leaf spring, a large elastic stroke can be achieved and the positioning of the tape cartridge 100C can be secured.

Note that the elastic member 342 constituted of a coil spring, rubber, and a sponge may be used instead of the elastic member 342 constituted of the leaf spring described above. In this case, the reception opening 340 is preferably formed in a groove-shaped receiving recessed portion.

What is claimed is:

1. A tape cartridge to be installed in a tape printing apparatus by which a printing tape is fed out to perform printing on the printing tape, the tape cartridge comprising:
- the printing tape;
- a cartridge casing in which the printing tape is accommodated; and
- a reaction force application portion that is provided on a front surface of the cartridge casing, displaced by a pressing force of a pressing portion of the tape printing apparatus, and applies a reaction force against the pressing force to the pressing portion according to a displacement of the reaction force application portion, wherein:
- the reaction force application portion includes an elastic portion elastically deformed by the pressing force,
- the elastic portion includes an elastic piece having a part with which the pressing portion comes in contact, the part being provided at an area formed by linearly cutting off a casing wall of the cartridge casing, and
- the elastic piece is formed by cutting off the casing wall into a "U"-shape.

2. The tape cartridge according to claim 1, wherein
- the reaction force is increased in proportion to a displacing amount of the reaction force application portion.

3. The tape cartridge according to claim 1, wherein
- the cartridge casing has a shell structure.

4. The tape cartridge according to claim 1, wherein
- the elastic piece is formed on the front surface of the cartridge casing at a corner portion of the front surface.

5. The tape cartridge according to claim 1, wherein
- the tape printing apparatus includes:
  - a cartridge installation portion on which the tape cartridge is installed;
  - an opening/closing cover that opens/closes the cartridge installation portion about a hinge portion; and
- the pressing portion that is provided on the opening/closing cover, and
- the elastic piece extends in a direction crossing an extending direction of the hinge portion, a side of the hinge portion of which is a base end.

6. The tape cartridge according to claim 1, wherein
- the reaction force application portion includes:
  - a receiving recessed portion that is formed on a casing wall of the cartridge casing and receives the pressing portion; and
  - an elastic member that is provided at the receiving recessed portion and constituted separately from the cartridge casing.

7. The tape cartridge according to claim 6, wherein
- the elastic member is made of at least one of a resin elastic material and a metal elastic material.

8. The tape cartridge according to claim 7, wherein
- the resin elastic material is made of at least one of rubber and a sponge.

9. The tape cartridge according to claim 7, wherein
- the metal elastic material is made of at least one of a leaf spring and a coil spring.

10. The tape cartridge according to claim 1, wherein
- the reaction force application portion faces the pressing portion and is provided on one surface of the cartridge casing crossing an installation direction, and
- a detected portion that detects attribute information of the printing tape is provided on the other surface of the cartridge casing.

11. The tape cartridge according to claim 1, wherein
- the reaction force application portion is disposed inside an outer contour line of the cartridge casing at a face of the cartridge casing facing the pressing portion.

12. A tape cartridge to be installed in a tape printing apparatus by which a printing tape is fed out to perform printing on the printing tape, the tape cartridge comprising:
- the printing tape;
- a cartridge casing in which the printing tape is accommodated; and
- a reaction force application portion that is provided on a front surface of the cartridge casing, displaced by a pressing force of a pressing portion of the tape printing apparatus, and applies a reaction force against the pressing force to the pressing portion according to a displacement of the reaction force application portion, wherein:
- the reaction force application portion includes an elastic portion elastically deformed by the pressing force, and
- the elastic portion includes:
  - an elastic piece that is formed in an L-shaped cross section on a plane section crossing the front surface of the cartridge casing, extends from a casing wall of the cartridge casing to an inside of the cartridge casing which is at an opposite side to the front surface, and with which the pressing portion coming in contact; and
  - a reception opening that is formed on the casing wall and receives the pressing portion.

13. The tape cartridge according to claim 12, wherein
- the reception opening includes two sides corresponding to both side ends of the elastic piece, and
- the tape cartridge is positioned by the pressing portion in a direction crossing the two sides.

14. A tape cartridge to be installed in a tape printing apparatus by which a printing tape is fed out to perform printing on the printing tape, the tape cartridge comprising:

the printing tape;

a cartridge casing in which the printing tape is accommodated; and a reaction force application portion that is provided on a front surface of the cartridge casing, displaced by a pressing force of a pressing portion of the tape printing apparatus, and applies a reaction force against the pressing force to the pressing portion according to a displacement of the reaction force application portion, wherein:

the reaction force application portion includes an elastic portion elastically deformed by the pressing force, the tape printing apparatus includes an installation base surface that positions the tape cartridge in the installation direction, a plurality of types of cartridge casings having a different thickness in the installation direction is available as the cartridge casing to be installed in the tape printing apparatus, and the reaction application portion in each of the cartridge casings is disposed such that a distance between the installation base surface and a part of the reaction application portion with which the pressing portion comes in contact becomes substantially equal among the plurality of types of the cartridge casings.

15. The tape cartridge according to claim 14, wherein the cartridge casing includes two casings having a split structure, and the reaction force application portion is provided on one of the two casings.

* * * * *